US009772578B2

(12) United States Patent
Nakajima et al.

(10) Patent No.: US 9,772,578 B2
(45) Date of Patent: Sep. 26, 2017

(54) IMAGE FORMING APPARATUS AND METHOD FOR COUNTING IMAGE SIGNALS WITH CHANGED IMAGE SIGNAL WIDTH

(71) Applicant: CANON KABUSHIKI KAISHA, Tokyo (JP)

(72) Inventors: Yuki Nakajima, Numazu (JP); Go Araki, Suntou-gun (JP); Hidenori Kanazawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/169,402

(22) Filed: May 31, 2016

(65) Prior Publication Data

US 2016/0370727 A1 Dec. 22, 2016

(30) Foreign Application Priority Data

Jun. 22, 2015 (JP) ..... 2015-125118
Mar. 17, 2016 (JP) ..... 2016-054471

(51) Int. Cl.
*G03G 15/043* (2006.01)
*G03G 21/14* (2006.01)

(52) U.S. Cl.
CPC ..... *G03G 15/043* (2013.01); *G03G 21/14* (2013.01)

(58) Field of Classification Search
CPC ..... G03G 15/043; G03G 21/14; G03G 15/556
USPC ..... 399/4, 27
See application file for complete search history.

(56) References Cited

U.S. PATENT DOCUMENTS 4,532,552 A 7/1985 Uno ..... 358/302
5,349,377 A * 9/1994 Gilliland ..... H04N 1/00002 347/131
8,891,092 B2 11/2014 Nakamura ..... B41J 2/471
2005/0147422 A1* 7/2005 Ahn ..... G03G 15/556 399/27
2006/0007509 A1* 1/2006 Imagawa ..... G03G 15/553 358/504

(Continued)

FOREIGN PATENT DOCUMENTS

JP S58-125064 A 7/1983
JP 2002-072770 3/2002

(Continued)

OTHER PUBLICATIONS

U.S. Appl. No. 15/040,436, filed Feb. 10, 2016.
U.S. Appl. No. 15/040,448, filed Feb. 10, 2016.

*Primary Examiner* — Sandra Brase
(74) *Attorney, Agent, or Firm* — Fitzpatrick Cella Harper & Scinto

(57) ABSTRACT

There is provided an image forming apparatus comprising: a scanning unit configured to scan, in accordance with image signals, a photosensitive member with laser light in a main scanning direction at a scanning speed that is not constant; an image signal generation unit configured to generate image signals that are changed such that the faster the scanning speed is, the narrower an image signal width becomes; a clock signal generation unit configured to generate sampling clock signals for sampling the image signals whose image signal width is changed such that the faster the scanning speed is, the shorter a sampling interval becomes; and a count unit configured to count image signals whose image signal width is changed based on the sampling clock signals.

20 Claims, 13 Drawing Sheets

(56) References Cited

U.S. PATENT DOCUMENTS

2007/0210245 A1 9/2007 Maeda ..... 250/234

FOREIGN PATENT DOCUMENTS

| | | |
|---|---|---|
| JP | 2007-249187 | 9/2007 |
| JP | 2010-072324 | 4/2010 |
| JP | 2012-121242 | 6/2012 |

* cited by examiner

IMAGE FORMING APPARATUS AND METHOD FOR COUNTING IMAGE SIGNALS WITH CHANGED IMAGE SIGNAL WIDTH

BACKGROUND OF THE INVENTION

Field of the Invention

The present invention relates to prediction of the remaining amount of a consumable material in an image forming apparatus such as an electrophotographic printer.

Description of the Related Art

Electrophotographic image forming apparatuses have an optical scanning unit for exposing a photosensitive member. The optical scanning unit emits laser light based on image data, reflects the laser light with a rotating polygon mirror, and causes the laser light to pass through a scanning lens, so as to irradiate and expose the photosensitive member. Scanning is performed in which a laser light spot formed on the surface of the photosensitive member is moved by rotating the rotating polygon mirror, whereby a latent image is formed on the photosensitive member.

The scanning lens is a lens having so-called an fθ (f-theta) characteristic. The fθ characteristic is an optical characteristic according to which the laser light forms an image on the surface of the photosensitive member, such that the laser light spot on the surface of the photosensitive member moves at a constant speed over the surface of the photosensitive member when the rotating polygon mirror is rotating at a constant angular velocity. Appropriate exposure can be performed by using the scanning lens having the fθ characteristic in this manner.

Such a scanning lens having the fθ characteristic is relatively large and expensive. Therefore, for the purpose of reducing the size and cost of the image forming apparatus, it has been considered to not use a scanning lens itself, or to use a scanning lens that does not have the fθ characteristic.

Japanese Patent Laid-Open No. 58-125064 discloses that electrical correction is performed so as to change an image clock frequency while one scanning operation is performed, such that even in the case where a laser light spot on the surface of the photosensitive member does not move at a constant speed over the surface of the photosensitive member, dots formed on the surface of the photosensitive member have a certain width.

Also, Japanese Patent Laid-Open No. 2002-72770 discloses a technique for obtaining image density information by counting (pixel counting) the presence/absence of an image signal every pixel at a predetermined frequency, and using the obtained image density information for estimating the consumption amount of a developing agent or the like.

However, if a conventional counting method is used in an image forming apparatus that performs scanning in a main scanning direction at a scanning speed that is not constant, there is a possibility that the accuracy for estimating the consumption amount deteriorates due to an error that occurs between the consumption amount of a developing agent that is actually consumed and the consumption amount of the developing agent that is obtained from the count value.

SUMMARY OF THE INVENTION

The present invention has been made in light of the above issue, and even in an image forming apparatus that performs scanning in the main scanning direction at a scanning speed that is not constant, suppresses the deterioration of accuracy for estimating the consumption amount of a developing agent.

The present invention has the following configuration.

According to one aspect of the present invention, there is provided an image forming apparatus comprising: a scanning unit configured to scan, in accordance with image signals, a photosensitive member with laser light in a main scanning direction at a scanning speed that is not constant; an image signal generation unit configured to generate image signals that are changed such that the faster the scanning speed is, the narrower an image signal width becomes; a clock signal generation unit configured to generate sampling clock signals for sampling the image signals whose image signal width is changed such that the faster the scanning speed is, the shorter a sampling interval becomes; and a count unit configured to count image signals whose image signal width is changed based on the sampling clock signals.

Alternatively, according to another aspect of the present invention, there is provided an image forming apparatus, comprising: a scanning unit configured to scan, in accordance with image signals, a photosensitive member with laser light in a main scanning direction at a scanning speed that is not constant; an image signal generation unit configured to generate image signals that are changed such that the faster the scanning speed is, the narrower an image signal width becomes; a clock signal generation unit configured to generate sampling clock signals for sampling image signals whose image signal width is changed; a count unit configured to count image signals whose image signal width is changed, based on the sampling clock signals; and a correction unit configured to correct a result of the counting performed by the count unit, using a weighting coefficient that is greater, the faster the scanning speed is.

According to the present invention, even in an image forming apparatus that performs scanning in a main scanning direction at a scanning speed that is not constant, it is possible to suppress the deterioration of accuracy for estimating the consumption amount of a developing agent.

Further features of the present invention will become apparent from the following description of exemplary embodiments with reference to the attached drawings.

DESCRIPTION OF THE EMBODIMENTS

Modes for carrying out the present invention will be exemplarily described in detail below based on examples with reference to the drawings. Note that the sizes, materials and shapes of the constituent elements described in the embodiments, the relative arrangement thereof and the like should be appropriately changed in accordance with the configuration of an apparatus to which the invention is applied and various conditions. That is, the scope of the invention is not limited to the following embodiments.

First Embodiment

Configuration of Image Forming Apparatus

Figure 1:
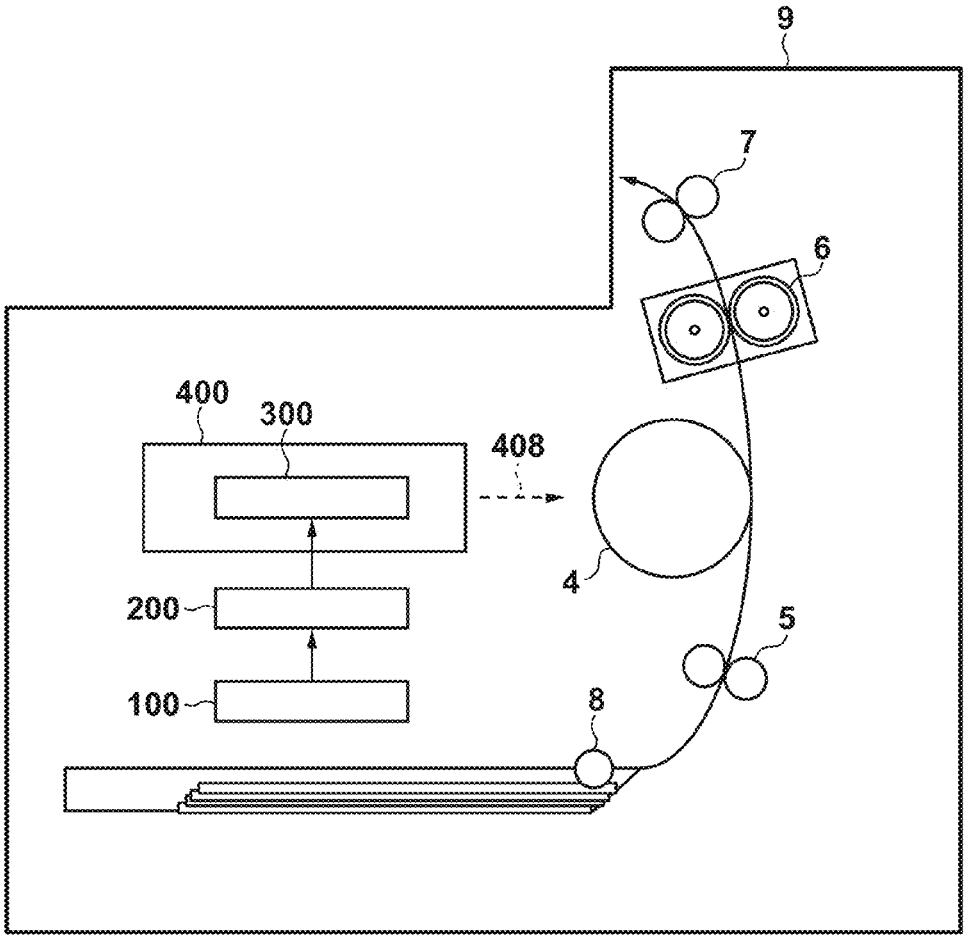
FIG. 1 is a schematic diagram showing the configuration of a first embodiment of the present invention.

FIG. 1 is a schematic diagram showing the configuration of an image forming apparatus 9. A laser driving unit 300 within a light scanning unit 400, which is a light scanner, turns on scanning light (laser light) 208 based on image signals output from an image signal generation unit 100, and control signals output from a control unit 200. A photosensitive member (photosensitive drum) 4 charged by a charger (not illustrated) is operated with the laser light 208 so as to form a latent image on the surface of the photosensitive drum 4. The scanning light 208 is modulated so as to be turned on/off based on image signals that have undergone pulse width modulation, for example. Toner is attached to the latent image formed on the photosensitive drum 4 by a developing means (not illustrated) for storing toner as a developing agent, thereby forming a toner image. The toner image is transferred to a recording medium such as paper, which is fed from a paper feeing unit 8 and whose skew is corrected using a registration roller 5. The toner image transferred to the recording medium is thermally fixed to the recording medium by a fixing device 6, and the recording medium is discharged out of the apparatus through a paper discharge roller 7.

Figure 2A:
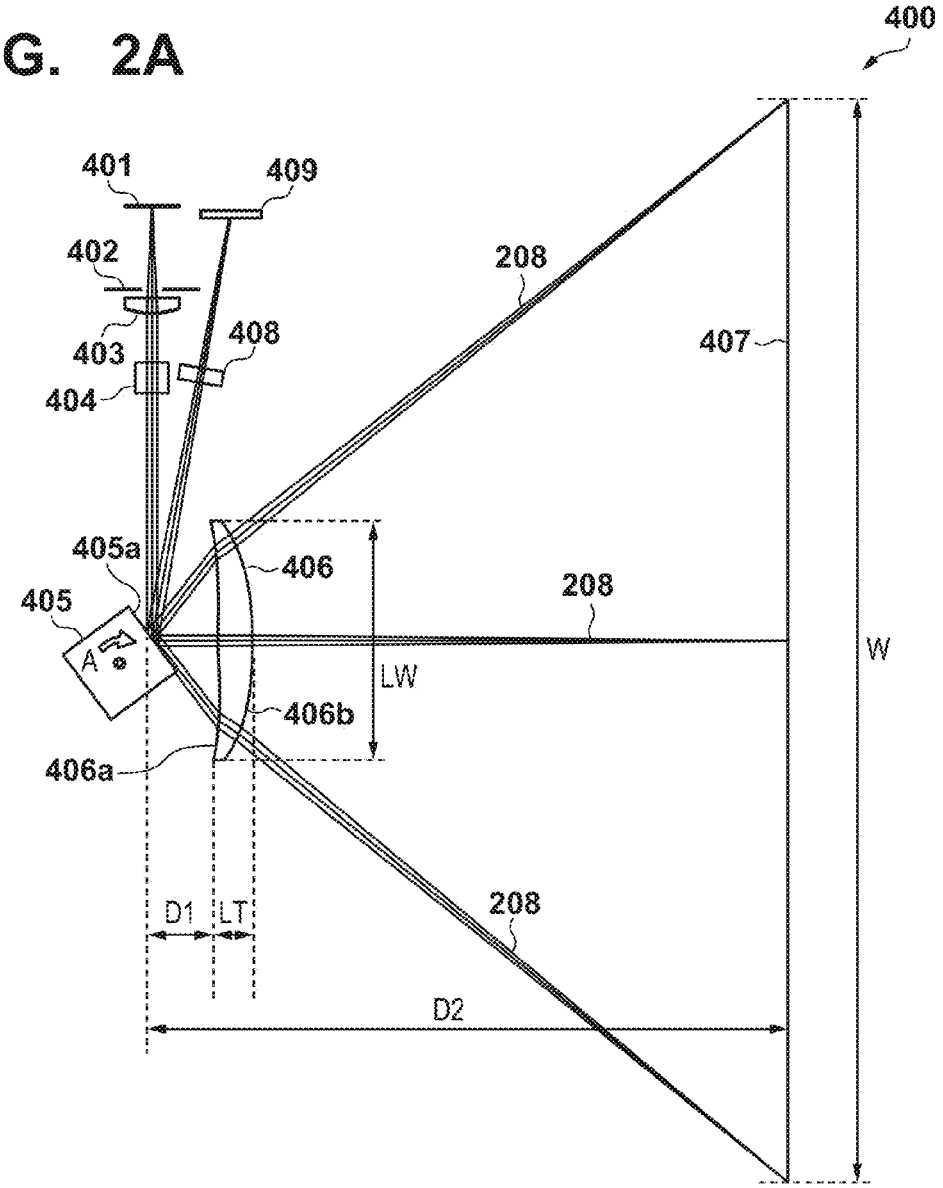
FIGS. 2A and 2B are cross-sectional views of an optical scanning apparatus of the first embodiment of the present invention.
Figure 2B:
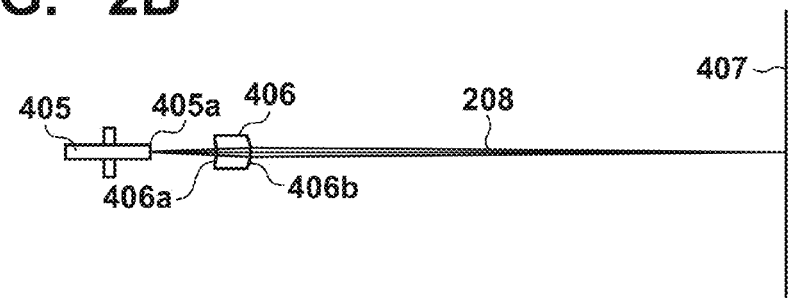

FIGS. 2A and 2B are cross-sectional views of the light scanning unit 400 according to this embodiment, FIG. 2A shows a main scanning cross section, and FIG. 2B shows a sub-scanning cross section. In this embodiment, a luminous flux emitted from a light source 401 is shaped into an elliptical shape by an opening diaphragm 402 and enters a coupling lens 403. The luminous flux that passed through the coupling lens 403 is converted into substantially parallel light, and enters an anamorphic lens 404. Note that the substantially parallel light includes weak convergent light and weak divergent light. The anamorphic lens 404 has positive refractive power in the main scanning cross section, and converts the entering luminous flux into convergent light in the main scanning cross section. In addition, the anamorphic lens 404 converges the luminous flux near a deflection surface 405*a* of a deflector 405 in the sub-scanning cross section, and forms a long line image in the main scanning direction.

The luminous flux that passed through the anamorphic lens 404 is then reflected and deflected on the deflection surface (reflection surface) 405*a* of the deflector (polygon mirror) 405, and enters an image forming lens 406 as an imaging optical element. The luminous flux reflected on the reflection surface 405*a*, as the laser light 208, passes through the image forming lens 406, and reaches the surface of the photosensitive drum 4. The image forming lens 406 is an image forming optical element. In this embodiment, an image forming optical system is constituted by only a single image forming optical element (image forming lens 406). The surface of the photosensitive drum 4 which the luminous flux that passes through the image forming lens 406 reaches is a scanning surface 407 that is scanned by the luminous flux. The luminous flux forms an image on the scanning surface 407 using the image forming lens 406, and a predetermined spot-like image (spot) is formed. The light scanning unit 400 forms an electrostatic latent image on the scanning surface 407 by rotating the deflector 405 at a constant speed in the direction of an arrow A using a driving unit (not illustrated), and performing light-scanning on the scanning surface 407 in the main scanning direction. Note that the main scanning direction is a direction that is parallel to the surface of the photosensitive drum 4 and is orthogonal to the movement direction on the surface of the photosensitive drum 4. A sub-scanning direction is a direction orthogonal to the main scanning direction and the optical axis of the luminous flux.

A beam detection (hereinafter, referred to as BD) sensor 409 and a BD lens 408 constitute a synchronization optical system for determining a timing for writing the electrostatic latent image onto the scanning surface 407. The synchronization optical system produces a converged state in the main scanning direction and a non-converged state in the sub-scanning direction on a BD slit (not illustrated) provided near the BD sensor 409, by allowing the luminous flux deflected and reflected on the deflection surface 405*a* to pass through the BD lens 408 having different refractive power in the main scanning and sub-scanning directions. Thereafter, the luminous flux that passed through the BD slit enters the BD sensor 409 constituted by a photodiode and the like, so as to be used for detecting a writing timing. At this time, by producing, on the BD sensor 409, a substantially converged state in the main scanning direction and a non-converged state in the sub-scanning direction, precise synchronization timing control is possible, even if fine dust or the like adheres to the BD sensor 409.

As the light source 401, for example, a semiconductor laser can be used, and the light emission unit thereof may emit one beam or a plurality of beams. In this embodiment, an elliptical diaphragm is adopted as the opening diaphragm 402, but there is no limitation on this and a rectangular diaphragm or the like may be adopted. In addition, in this embodiment, the coupling lens 403 and the anamorphic lens 404 that constitute an incident optical system are provided individually, but a single optical element in which the optical functions of those lenses are integrated may constitute the incident optical system. Note that in this embodiment, as the deflector 405, the rotating polygon mirror (polygon mirror) that has four deflection surfaces is adopted, but the number of deflection surfaces may be five or more.

The image forming lens 406 has two optical surfaces (lens surfaces), namely an incident surface (first surface) 406*a* and an emission surface (second surface) 406*b*, and is constituted such that the luminous flux deflected on the deflection surface 405*a* is used for performing scanning on the scanning surface 407 in the main scanning cross section with desired scanning characteristics. The image forming lens 406 also performs plane tilt compensation (reduces the displacement of a scanning position in the sub-scanning direction on the scanning surface 407 when the deflection surface 405*a* tilts) in the sub-scanning cross section, by ensuring a conjugate relationship between the vicinity of the deflection surface 405*a* and the vicinity of the scanning surface 407. Note that the image forming lens 406 according to this embodiment is a plastic molded lens formed by injection molding, but a glass molded lens may be adopted as the image forming lens 406. A molded lens is easily shaped into an aspherical shape and suitable for mass production, and thus by adopting a molded lens as the image forming lens 406, improvement in productivity and optical performance can be achieved.

The image forming lens 406 does not have so-called the fθ characteristic. Specifically, the image forming lens 406 does not have scanning characteristics that allow the luminous flux spot that passes through the image forming lens 406 to move over the scanning surface 407 at a constant speed when the deflector 405 is rotating at a constant angular velocity. By using the image forming lens 406 that does not have the fθ characteristic as described above, the image forming lens 406 can be arranged in proximity to the deflector 405 (at a position at which a distance D1 is small). In addition, the image forming lens 406 that does not have the fθ characteristic can be made smaller in the main scanning direction (width LW) and the optical axis direction (thickness LT) than an image forming lens that has the fθ characteristic. Accordingly, reduction in size of a casing 400*a* of the light scanning unit 400 (see FIG. 1) is realized. In addition, in the case of a lens having the fθ characteristic, the shapes of the incident surface and emission surface of the lens when viewed in the main scanning cross section may change steeply, and in the case where the shapes are limited in such a manner, there is a possibility that favorable image forming performance will not be obtained. On the other hand, the image forming lens 406 does not have fθ characteristic, and thus there is not much steep change in the shapes of the incident surface and emission surface of the lens when viewed in the main scanning cross section, making it possible to obtain favorable image forming performance.

Characteristics of Image Forming Lens 406

The scanning characteristics of the image forming lens 406 according to this embodiment are expressed by Expression (1) below.

$$Y=K/B\cdot\tan(B\theta) \quad (1)$$

Note that in Expression (1), θ is the scanning angle (scanning angle of view) formed by the deflector 405, Y [mm] is the converging position (image height), on the scanning surface 407 in the main scanning direction, of the luminous flux deflected at the scanning angle θ, K [mm] is an image forming coefficient at an on-axis image height, and B is a coefficient for determining the scanning characteristics of the image forming lens 406 (hereinafter, referred to as a scanning characteristics coefficient). The scanning angle θ is assumed to be 0 in the optical axis direction of the image forming lens 406, in other words, the direction of a light beam entering from the image forming lens 406 that is orthogonal to the scanning surface 407. Note that in this embodiment, the on-axis image height refers to the image height on the optical axis (Y=0), and corresponds to the scanning angle θ=0. Also, an off-axis image height refers to an image height (Y≠0) that is outer relative to the central optical axis (if the scanning angle θ=0), and corresponds to the scanning angle θ≠0. Furthermore, the outermost off-axis image height refers to an image height when the scanning angle θ is a maximum (the maximum scanning angle of view). Here, the image forming coefficient K is a coefficient corresponding to f in the scanning characteristics (fθ characteristic) Y=fθ in the case where parallel light enters the image forming lens 406. That is, the image forming coefficient K is a coefficient for obtaining the proportional relationship between the converging position Y and the scanning angle θ similarly to the fθ characteristic, in the case where luminous flux other than the parallel light enters the image forming lens 406.

To provide an additional explanation regarding the scanning characteristics coefficient, Y=Kθ holds true in Expression (1) if B is 0, and thus the scanning characteristics coefficient corresponds to Y=fθ, where Y is the scanning characteristic of the image forming lens that is used in a conventional optical scanning apparatus. Moreover, Y=Ktanθ holds true in Expression (1) if B=1, and thus the scanning characteristics coefficient corresponds to Y=ftanθ, where Y is the projecting characteristic of a lens used for an image capturing apparatus (camera) or the like. Accordingly, by setting the scanning characteristics coefficient B within a range of 0≤B≤1 in Expression (1), the scanning characteristics between the projecting characteristics Y=ftanθ and the fθ characteristic Y=fθ can be obtained.

Here, if Expression (1) is differentiated with the scanning angle θ, the scanning speed of the luminous flux on the scanning surface 407 for the scanning angle θ is obtained as indicated by Expression (2) below.

$$dY/d\theta=K/(\cos^2(B\theta)) \quad (2)$$

Furthermore, if Expression (2) is divided by the speed at the on-axis image height dY/dθ=K, Expression (3) is obtained.

$$(dY/d\theta)/K-1=1/(\cos^2(B\theta))-1=\tan^2(B\theta) \quad (3)$$

Expression (3) represents partial magnification, which is the amount of deviation of the scanning speed at each of off-axis image heights from the scanning speed at the on-axis image height. In the cases other than the case of B=0, in the light scanning unit 400 according to this embodiment, the luminous flux scanning speed is different between the on-axis image height and off-axis image heights. Specifically, the scanning speed over the surface for scanning is faster in a central portion in the main scanning direction than in an end portion.

Figure 3:
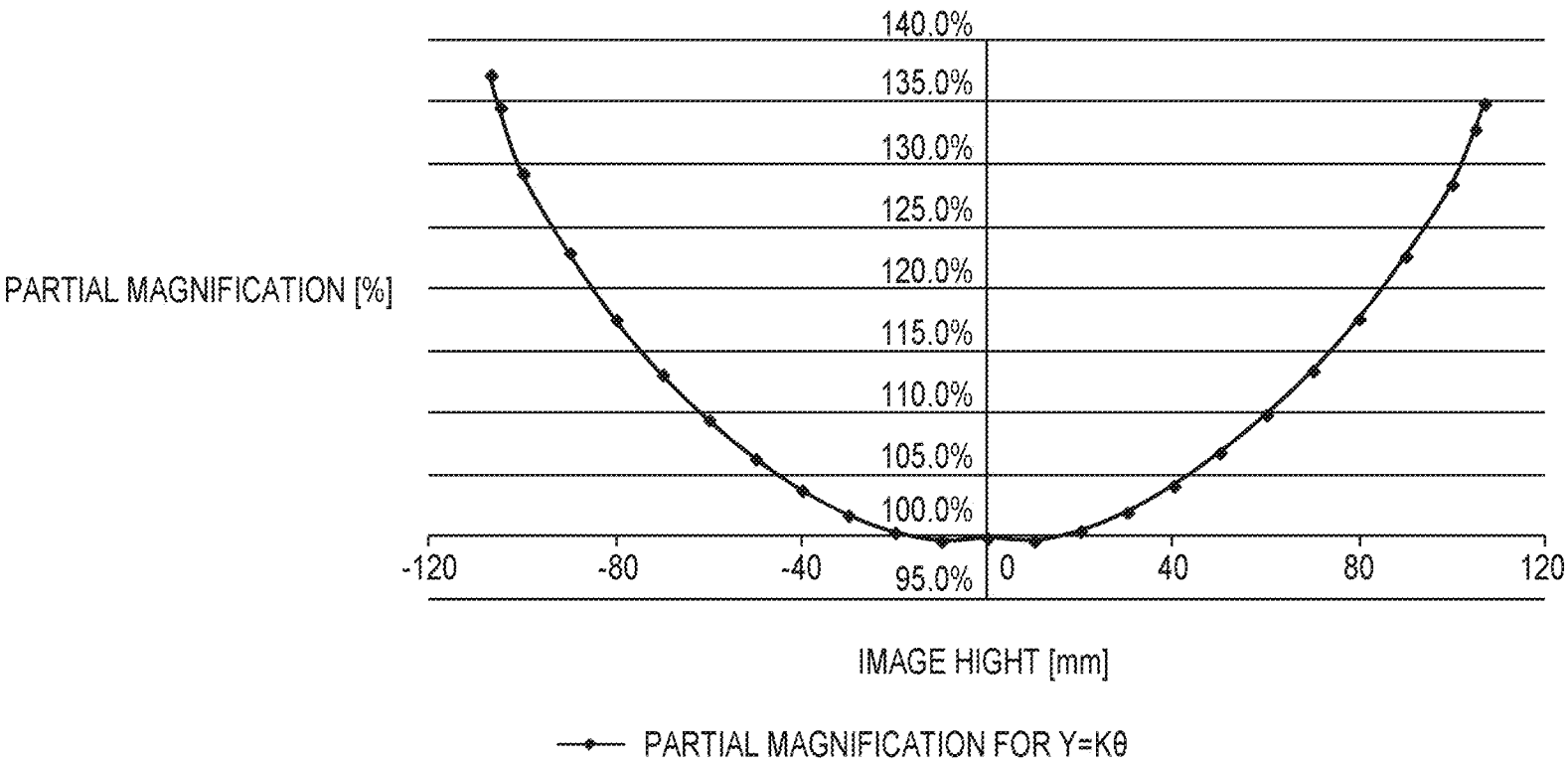
FIG. 3 is a characteristics graph of partial magnification at an image height of the optical scanning apparatus of the first embodiment of the present invention.

FIG. 3 shows the relationship between an image height and partial magnification when a scanning position on the scanning surface 407 according to this embodiment is fitted by the characteristics of Expression (1) (note that B≠0). In this embodiment, by providing the scanning characteristics indicated in Expression (1) to the image forming lens 406, as shown in FIG. 3, the scanning speed gradually becomes faster from the on-axis image height to an off-axis image height, and thus the partial magnification increases. Partial magnification of 130% indicates that in the case where light is emitted for the same time period, a radiation length toward the scanning surface 407 in the main scanning direction is 1.3 times the on-axis image height. Therefore, if the pixel width in the main scanning direction is determined with a constant time interval determined in accordance with the image clock cycle, the pixel density differs between the on-axis image height and an off-axis image height.

In addition, as the image height Y is separated from the on-axis image height and approaches the outermost off-axis image height (as the absolute value of the image height Y becomes greater), the scanning speed gradually becomes faster. Accordingly, the time required for the scanning per unit length when the image height on the scanning surface 407 is near the outermost off-axis image height is shorter than the time required for the scanning per unit length when the image height is near the on-axis image height. This means that, in the case where the emission luminance of the light source 401 is constant, the total exposure amount per unit length when the image height is near the outermost off-axis image height is smaller than the total exposure amount per unit length when the image height is near the on-axis image height.

In the case of an optical configuration that does not include the above-described fθ characteristic as described above, there is a possibility that partial magnification in the main scanning direction and variation in total exposure amount per unit length are not appropriate for maintaining favorable image quality. In view of this, in this embodiment, in order to obtain good image quality, correction of the above-described partial magnification and luminance correction for correcting the total exposure amount per unit length are performed.

Image Signal Generation Unit, Control Unit and Laser Driving Unit

Figure 4:
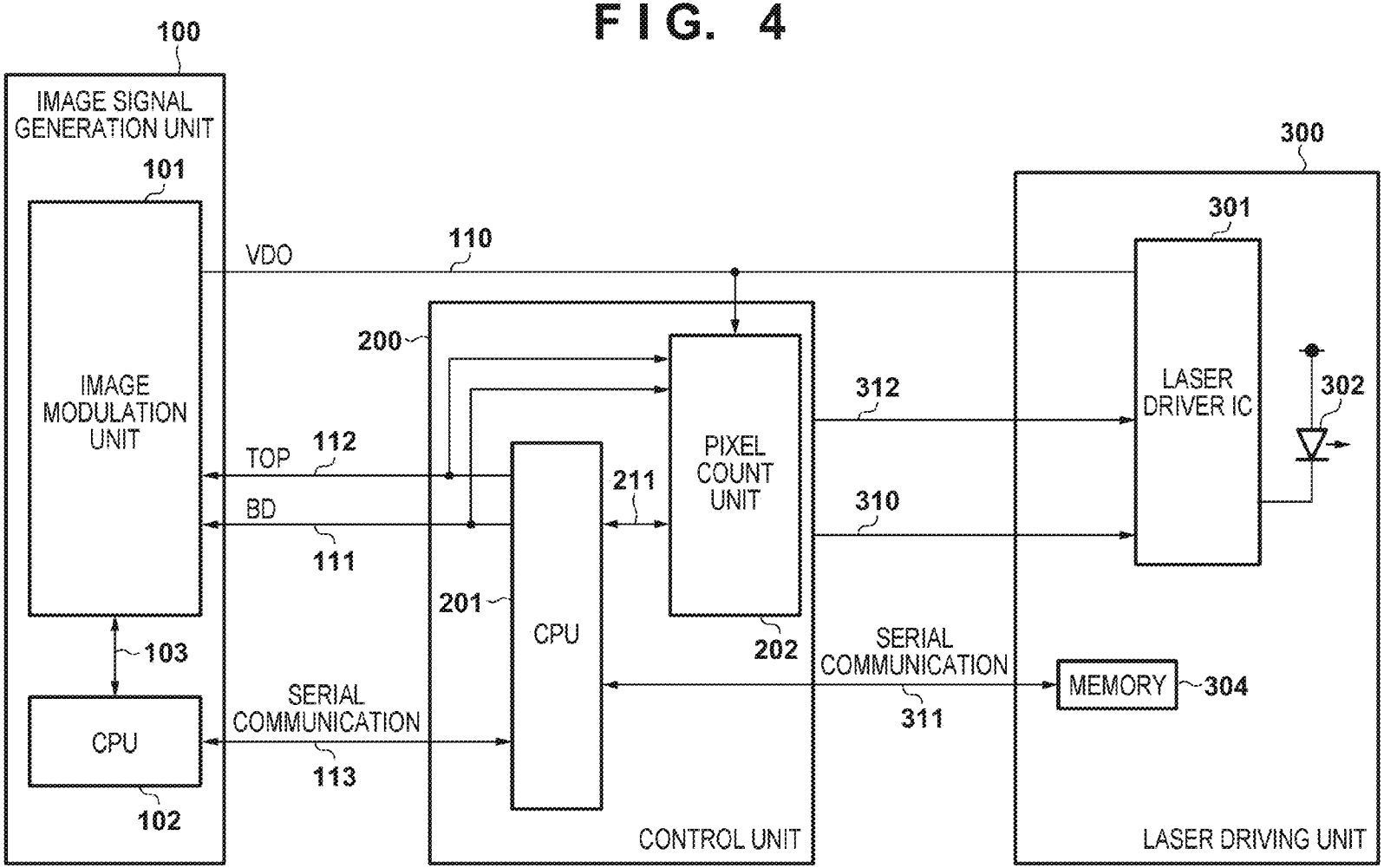
FIG. 4 is an electrical block diagram relating to image formation of the first embodiment of the present invention.

FIG. 4 is an electrical block diagram of image formation of the image forming apparatus 9. The image signal generation unit 100 receives printing information from a host computer (not illustrated), and generates VDO signals 110. The control unit 200 controls the image forming apparatus 9, and counts the presence/absence of pixels in the VDO signals 110. The image signal generation unit 100 changes, based on partial magnification characteristics information that will be described later, the image signal width for one pixel of a VDO signal to a width corresponding to the position on a main scanning line, and outputs the VDO signals 110. That is, even without an fθ lens, the VDO signal is corrected such that the pixel width on the main scanning line is constant. The laser driving unit 300 is equipped with a memory 304, a laser driver IC 301, and a semiconductor laser (hereinafter, referred to as a laser) 302 that is the light source 401. The partial magnification characteristics information (alternatively, referred to as partial magnification information) as well as information regarding a correction current for the laser 302 are saved in the memory 304. Regarding the partial magnification characteristics information, partial magnification information at a plurality of image heights in the main scanning direction is stored. Instead of the partial magnification information, scanning speed characteristics information may be stored. This information may be measured and stored by individual apparatuses after the light scanning unit 400 is assembled, or representative characteristics may be stored without performing individual measurement. The operations of the image signal generation unit 100, the control unit 200 and the laser driving unit 300 will be described below.

A CPU 201 reads out the partial magnification characteristics information from the memory 304 via serial communication 311, and sends the partial magnification characteristics information to a CPU 102 in the image signal generation unit 100. The CPU 102 generates partial magnification correction information based on this partial magnification characteristics information, and sends the partial magnification correction information to an image modulation unit 101 via a CPU bus 103. Similarly, the CPU 102 transmits the partial magnification correction information to a pixel count unit 202 in the control unit 200 as well via the serial communication 113, the CPU 201 and a CPU bus 211.

The image signal generation unit 100 instructs the control unit 200 to start printing through the serial communication 113, when the preparation of image signal output for image formation is completed. The control unit 200 starts driving the semiconductor laser 302 and the deflector 405, and when the preparation for printing is completed, transmits TOP signals 112 that are sub-scanning synchronization signals and BD signals 111 that are main scanning synchronization signals to the image signal generation unit 100. Upon receiving the synchronization signals, the image signal generation unit 100 sends the VDO signals 110, which are image signals, to the laser driving unit 300 and the control unit 200 at a predetermined timing. Here, the VDO signals 110 that are sent are image signals that were subjected to partial magnification correction based on the above-described partial magnification correction information. That is, if a value of 1.25 times is instructed as the partial magnification correction information at a certain main scanning position, image signals whose pixel width is 0.8 times will be output as the VDO signals.

The laser driver IC 301 in the laser driving unit 300 controls lighting/extinction of the laser 302 based on laser control signals 310 of the control unit 200 and the VDO signals 110, and forms a latent image on the scanning surface 407 of the photosensitive drum 4 charged in advance. At the same time, the laser driver IC 301 also performs correction of the laser emission luminance during main scanning, based on luminance correction signals 312 output from the control unit 200. The luminance correction signals 312 are generated by the control unit 200 based on the above-described partial magnification characteristics information, and are used for an application for adjusting the light amount of the laser 302 during the main scanning such that the integrated light amount during the main scanning becomes constant. In this embodiment, the control unit 200 transmits an analog value corresponding to the light amount of the laser 302 as the luminance correction signal 312 to the laser driver IC 301, and the laser driving unit 300 receives the luminance correction signal 312 and performs light amount correction, but the laser driver IC 301 may directly calculate a luminance correction amount internally, based on the partial magnification characteristics information held in the memory 304 and perform light amount correction of the laser 302.

Moreover, the VDO signals 110 are sent to the laser driving unit 300 as well as the pixel count unit 202 in the control unit 200. The pixel count unit 202 counts the presence/absence of pixels included in the image signals, by referring to the VDO signals 110.

Configuration of Pixel Count Unit

Figure 5:
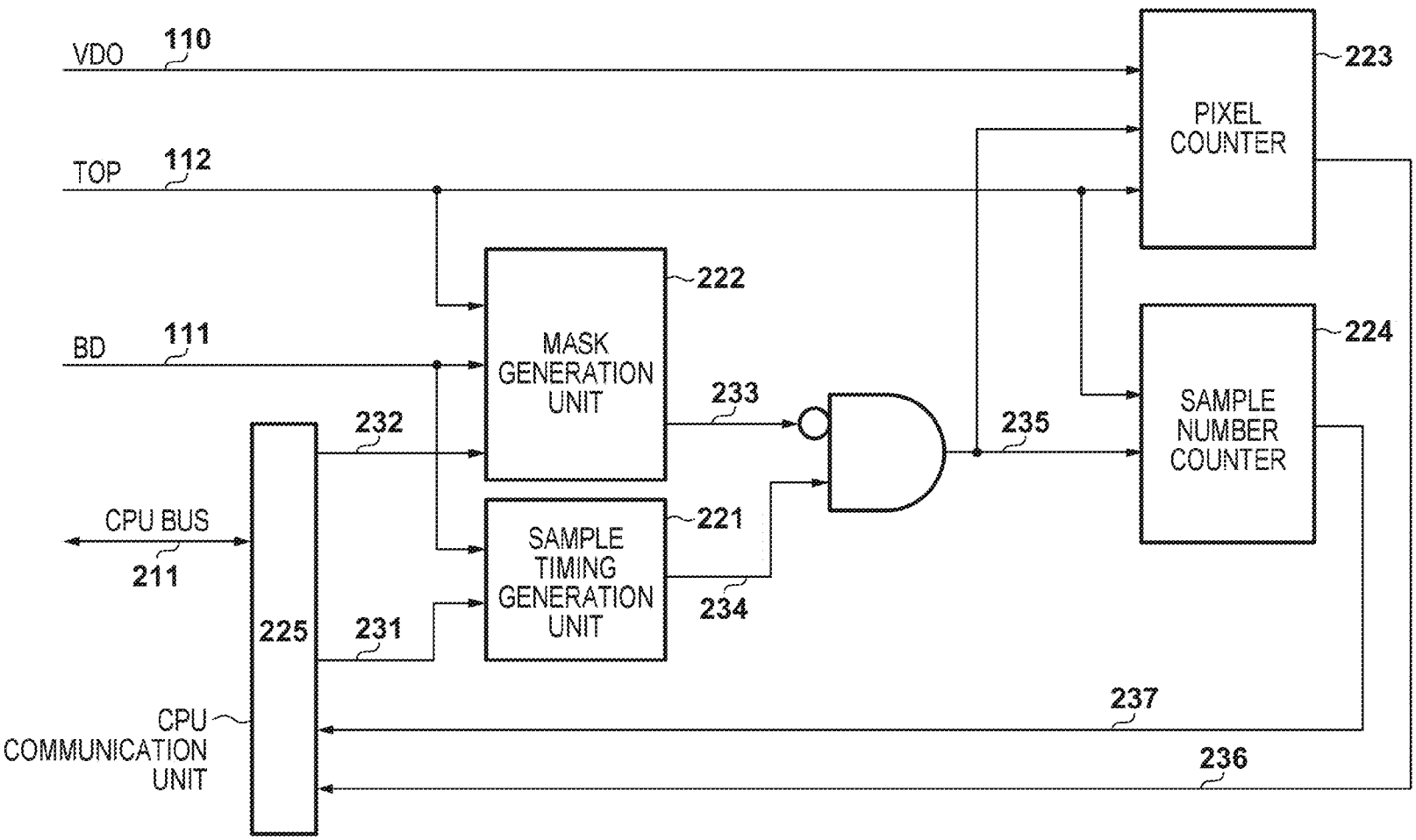
FIG. 5 is a block diagram relating to pixel counting of the first embodiment of the present invention.

FIG. 5 shows the internal block diagram of the pixel count unit 202. A CPU communication unit 225 transmits various setting values to a sample timing generation unit 221 and a mask generation unit 222. Regarding the sample timing generation unit 221, the various setting values indicate the partial magnification correction information received via the CPU bus 211, and regarding the mask generation unit 222, the various setting values indicate information indicating sub-scanning mask start and end timings that are based on the TOP signals 112, and information indicating main scanning mask start and end timings that are based on the BD signals 111. In this embodiment, pixel counting performed by the pixel count unit 202 is performed in image areas excluding the areas corresponding to the above-described sub-scanning mask and main scanning mask. In the following description, the setting value to be transmitted to the sample timing generation unit 221 is referred to as partial magnification correction information 231, and the setting value to be transmitted to the mask generation unit 222 is referred to as an image mask setting 232.

The sample timing generation unit 221 generates sample timing signals (also referred to as sampling clock signals) 234 to be transmitted to a pixel counter 223 and a sample number counter 224. Therefore, the sample timing generation unit 221 is also referred to as a clock signal generation unit. The sample timing signals 234 adjust the output cycle so as to be inversely proportional to the partial magnification in the main scanning based on the partial magnification correction information 231, using the BD signal 111 as a main scanning start reference. In this embodiment, for example, assuming that the image clock cycle at the on-axis image height is determined as a reference image clock, the output cycle of the sample timing signals 234 at the scanning position at which the partial magnification becomes 100% is 100/100 of (in other words, same as) a reference image clock cycle, and the output cycle of the sample timing signals 234 at the scanning position at which the partial magnification becomes 125% is 100/125 (namely, 80%) of the reference image clock cycle. That is, letting that the partial magnification at a certain image height be m×100 (%), the output cycle of the sample timing signals 234 at this image height is assumed to be 1/m×100 (%). A configuration can be adopted in which the cycle of the sample timing signals 234 is determined as a function of a lapsed time (corresponding to the image height) using a BD signal as a start point, for example. In other words, the sampling interval between the sampling clock signals is shorter in an end portion than in a central portion. Note that the sampling clock signals may be changed consecutively, but the main scanning line may be divided into several areas such that a sampling clock signal is set for each area. In addition, the interval between the sample timing signals is also referred to as a sampling interval.

The mask generation unit 222 changes mask signals 233 to a "LOW" level in an area in which an image is rendered in accordance with the image mask setting 232 determined in advance based on the TOP signals 112 and the BD signals 111. Only during the time when the mask signals 233 are at a "LOW" level, in other words, while the image is being rendered, the sample timing signals 234 are propagated as in-image area sample timing signals (hereinafter, simply referred to as sample timing signals) 235 to the pixel counter 223 and the sample number counter 224.

The pixel counter 223 has a counter therein that counts valid pixels of the VDO signals 110. Upon receiving the TOP signals 112, namely sub-scanning synchronization signals, the pixel counter 223 clears the held pixel count value 236 to 0. When the sample timing signals 235 are at a "HIGH level" and the VDO signals 110 are at a "HIGH" level, the pixel counter 223 increases the pixel count value 236 by one. Specifically, using the sample timing signals 235 as synchronization signals, the pixel counter 223 counts the VDO signals 110 that are at a "HIGH" level.

The sample number counter 224 has a counter therein that counts the number of times of receiving the in-image area sample timing signals 235. Upon receiving the TOP signals 112, the sample number counter 224 clears a sample count value 237 held by itself to 0. When the sample timing signals 235 are at a "HIGH" level, the sample number counter 224 increases the sample count value 237 by one.

The pixel count value 236 and the sample count value 237 are sent to the CPU communication unit 225, and are transmitted to the CPU 201 via the CPU bus 211. The pixel count value 236 and the sample count value 237 are cleared every time the TOP signal 112 is received, and thus the CPU communication unit 225 and the CPU 201 can obtain a count value for each page of the image every time an image is formed. The CPU 201 can obtain, from the proportion of the pixel count value 236 to the received sample count value 237, a laser lighting ratio in one page of the image. In addition, by using the laser lighting ratio and a toner consumption amount prediction table (not illustrated), the CPU 201 can predict the toner consumption amount (consumption amount of a developing agent). In the toner consumption amount prediction table, toner consumption amounts are stored in correlation to laser lighting ratios and page sizes, for example. There is a possibility that the relationship between the laser lighting ratio and the toner consumption amount takes different values depending on the product, and thus it is preferable to measure toner consumption amounts for a plurality of laser lighting ratios in advance, and generate a toner consumption amount table. It is sufficient that the toner consumption amount corresponding to the laser lighting ratio and, for example, the page size are read out for toner consumption amount prediction. Off course, this is an example, and any method may be used as long as it is a method for estimating the consumption amount of a color agent (developing agent) such as toner, by using the pixel count value 236 obtained due to the configuration in FIG. 5. Note that estimating the consumption amount of a developing agent can be paraphrased as estimating the remaining amount of the developing agent. Specifically, for example, by subtracting an amount corresponding to the pixel count value 236 from the amount of 100% of the developing agent stored in a developing device, it is possible to estimate the remaining amount of the developing agent stored in the developing device.

Description on Signals

Figure 6A:
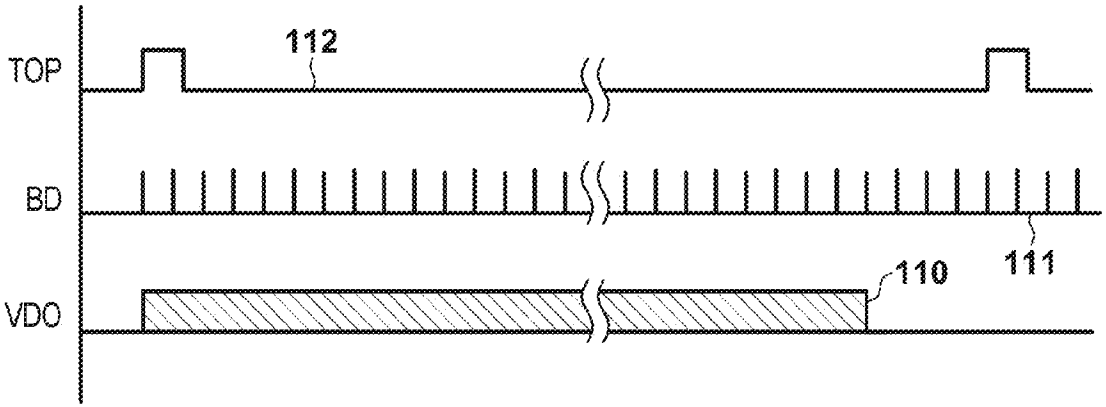
FIGS. 6A to 6D are timing charts of synchronization signals and image signals of the first embodiment of the present invention.

The relationship between the TOP signals 112, the BD signals 111, the VDO signals 110 and the in-image area sample timing signals 235 will be described in detail with reference to time charts in FIGS. 6A to 6D. FIG. 6A is a diagram showing timings of various synchronization signals and image signals. The TOP signals 112 at a "HIGH" level indicate that the leading edge of the recording medium has reached a predetermined position. Upon receiving the TOP signals 112 that are at a "HIGH" level, the image signal generation unit 100 sends the VDO signals 110 in synchronization with the BD signals 111.

Figure 6B:
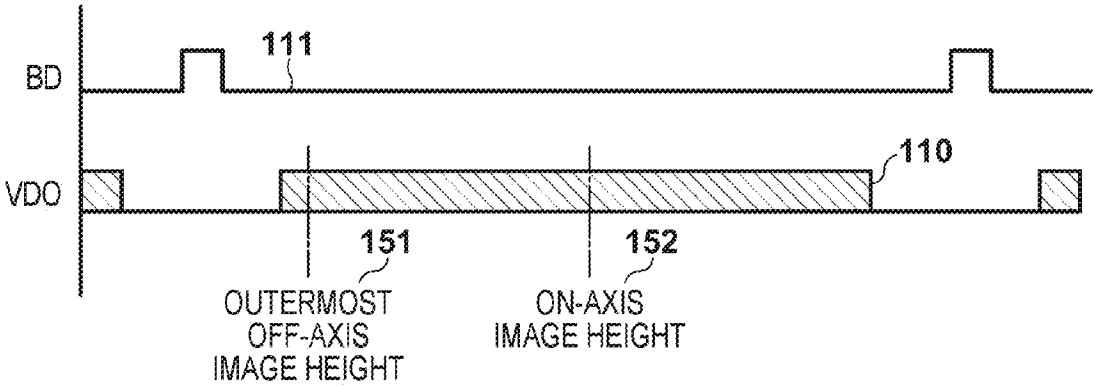

FIG. 6B is a diagram showing the timings of the BD signals 111 and the VDO signals 110. Upon receiving the rising edge of the BD signals 111, the image signal generation unit 100 sends the VDO signals 110 after a predetermined timing such that an image can be printed at a desired position from the left end edge of the recording medium. The VDO signals 110 in FIG. 6B represent signals for one main scanning operation, and the end portion of the frame of mask signals comes at the outermost off-axis image height 151, substantially centered on the on-axis image height 152. Although not illustrated in FIG. 6B, a position symmetrical to the outermost off-axis image height 151 also comes at the outermost off-axis image height, centered on the on-axis image height 152. Note that the sign of the value indicating the image height is inverted.

Figure 6C:
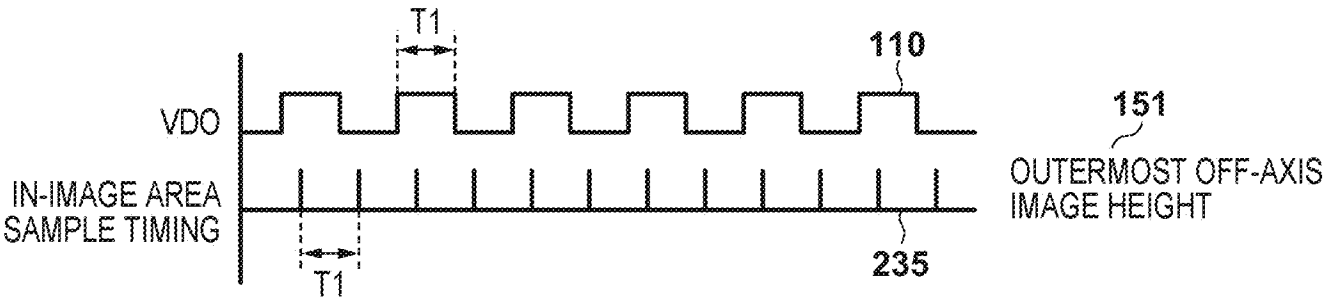
Figure 6D:
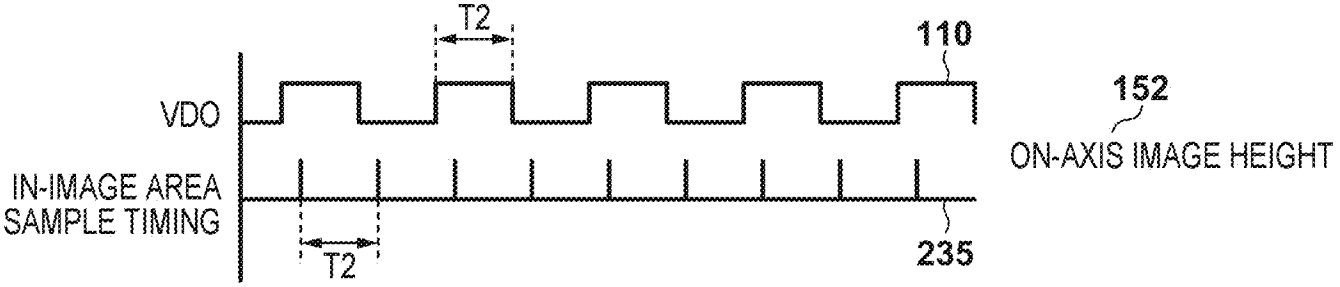

FIGS. 6C and 6D are diagrams showing the timings of the VDO signals 110 and the in-image area sample timing signals 235. In this embodiment, as an suitable example for describing the operations, the case in which the VDO signals 110 are aligned on a one-dot-one-space basis in the main scanning direction, in other words, pixels are consecutively aligned is shown in FIG. 6C. However, this embodiment can be applied to other image patterns. Signals near the outermost off-axis image height 151 are shown in FIG. 6C, signals near the on-axis image height 152 are shown in FIG. 6D, the image clock cycle of the VDO signals 110 in FIG. 6C is denoted by T1, and the image clock cycle of the VDO signals 110 in FIG. 6D is denoted by T2. As described above, the scanning speed over the scanning surface 407 is faster at the on-axis image height 152 than at the outermost off-axis image height 151, and thus by setting an image clock cycle T2 to be longer than an image clock cycle T1, correction is performed such that the main scanning pixel width on the scanning surface 407 is constant. The pixel count unit 202 changes the output cycle of the in-image area sample timing signals 235 during main scanning based on the partial magnification characteristics information. Accordingly, a configuration is possible in which the in-image area sample timing signal 235 is output once during the time period in which one pixel is output with the VDO signal 110, and thus it becomes possible to execute pixel counting always at a constant interval in the image.

Note that as described above, in this embodiment, the time for one pixel value is changed in accordance with the image height, and thus in order to accordingly correct the change in exposure light amount that is based on the image height, the emission luminance of the light source is also changed in accordance with the image height. Accordingly, for pixels of the same density, toner of the same amount will be consumed regardless of the image height. Accordingly, a toner consumption amount can be estimated with high accuracy based on the pixel count value in this embodiment.

In this embodiment, although a configuration is adopted in which pixel sampling is executed only once for one main scanning pixel, a configuration may be adopted in which pixel sampling is executed a plurality of times for one main scanning pixel. In that case as well, by a method similar to this embodiment, pixel counting is executed while changing the output cycle of the in-image area sample timing signals 235 during the main scanning. By executing pixel sampling a plurality of times for one scanning pixel, it is possible to obtain a more accurate result.

Note that in this embodiment, for the purpose of simplifying the description, the description was given assuming that the number of the light sources 401 is one, but a plurality of light sources 401 may be included depending on the configuration of the image forming apparatus 9. In that case, the VDO signals 110, the number of which corresponds to the number of the light sources 401, will be prepared. Note that if all the VDO signals 110 are input to the pixel count unit 202, a plurality of pixel counters 223 in the pixel count unit 202 are necessary, thereby scaling up the circuit. Therefore, if the accuracy of pixel counting required by the image forming apparatus 9 can be satisfied, this embodiment can be implemented even if the image forming apparatus 9 is constituted by the VDO signals 110 targeted for pixel counting and the pixel counters 223 that are thinned-out to the required number in order to suppress the increase in cost of the circuit.

With the above configuration, even in the case of an image forming apparatus that performs pixel width correction by correcting partial magnification during main scanning, main scanning synchronization signals based on the corrected pixel width are generated, pixel counting is performed on the image signals using the main scanning synchronization signals as synchronization signals, the lighting ratio of a light source, namely the laser lighting ratio is obtained, and the toner consumption amount is predicted. The predicted toner consumption amount is transmitted to the image signal generation unit 100, for example. Furthermore, the predicted toner consumption amount can be transmitted to a computer or the like, which is the host apparatus of the image forming apparatus. Accordingly, even in an image forming apparatus that does not have an fθ lens and performs pixel width correction in the main scanning direction based on the image height, it becomes possible to estimate the toner consumption amount with high accuracy. In addition, the mask signals 233 and the sample timing signals 235 are independently generated by the pixel count unit 202, and thus the degree of freedom for toner estimation is increased, for example, the frequency of the sample timing signals is set to be longer than the image clock and pixels targeted for toner estimation are thinned out, or a sampling area for toner estimation is narrowed using mask signals. Furthermore, it is not necessary to perform branching of high frequency image clock signals or long distance wiring, and the sample timing signals can be completed within the pixel count unit 202 without the image clock signals being adversary influenced, thereby making it possible to suppress the influence of high frequency signals on other circuits.

Note that in this embodiment and the second embodiment, instead of adding one to the pixel count, the values of the VDO signals may be integrated. Accordingly, even if the VDO signals correspond to multi-value image data, toner consumption estimation becomes possible. In this case, the sample timing signals are converted, with the count value for one pulse thereof corresponding to the maximum density level, for example. In addition, in the case of color image data, the pixel counter 223 is prepared for each color component. Moreover, the number of pixels for one page is approximately identified in accordance with the page size and recording density according to which an image is formed. In view of this, a configuration is possible in which excluding the sample number counter 224, the number of pixels for one page that is based on the page size and recording density is stored in a ROM or the like in advance, and the value is used as a sample count value for each page.

In this embodiment, although the image signal generation unit 100 performs partial magnification correction by adjusting the image signal width, partial magnification correction may be performed by inserting/removing pixel pieces. In that case as well, it is possible to implement pixel counting without changing the configuration of the pixel count unit 202. Adjustment of image signal width is performed by thinning out pieces of image data such that the faster the scanning speed is, the narrower the image signal width becomes, and/or inserting pieces of image data such that the slower the scanning speed is, the wider the image signal width becomes, for example.

Second Embodiment

In this embodiment, a configuration will be described in which a result similar to the first embodiment is obtained by weighting the calculation of an accumulation result of pixel counting. The difference is that the pixel count unit 202 of the first embodiment is changed to a pixel count unit 702. The configuration of this embodiment will be described below. The same reference numerals are assigned to the constituent elements similar to those in the first embodiment and the description thereof is omitted.

Figure 7:
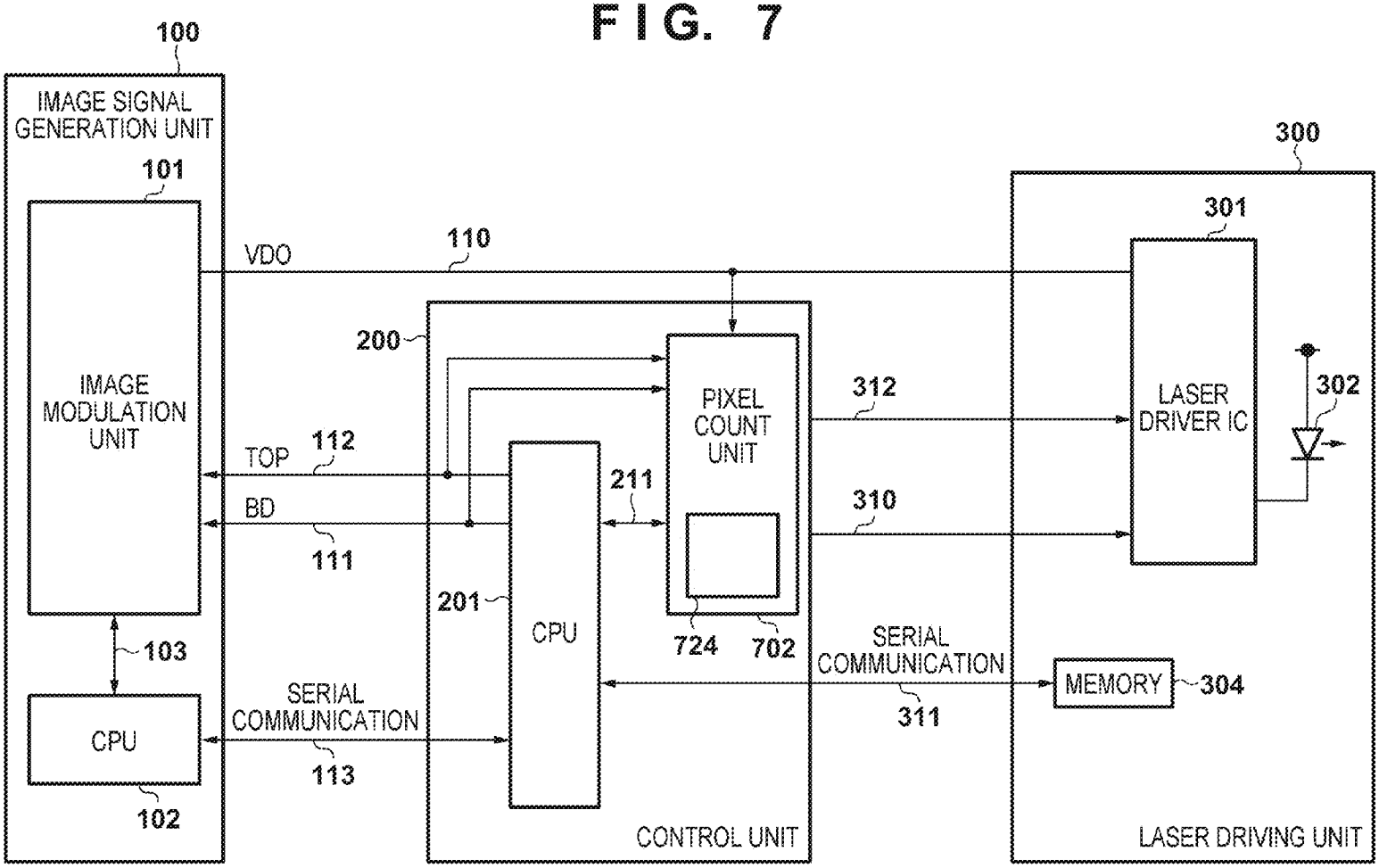
FIG. 7 is an electrical block diagram relating to image formation of a second embodiment of the present invention.

FIG. 7 is an electrical block diagram of image formation of this image forming apparatus 9 in this embodiment. This example is the same as the first embodiment in that the pixel count unit 702 receives the partial magnification characteristics information from the CPU 201 via the CPU bus 211 and obtains various setting values, and only processing executed by the pixel count unit 702 is different. Note that this embodiment is different from the first embodiment in that the pixel count unit 702 has a weighting calculation unit 724.

Figure 8:
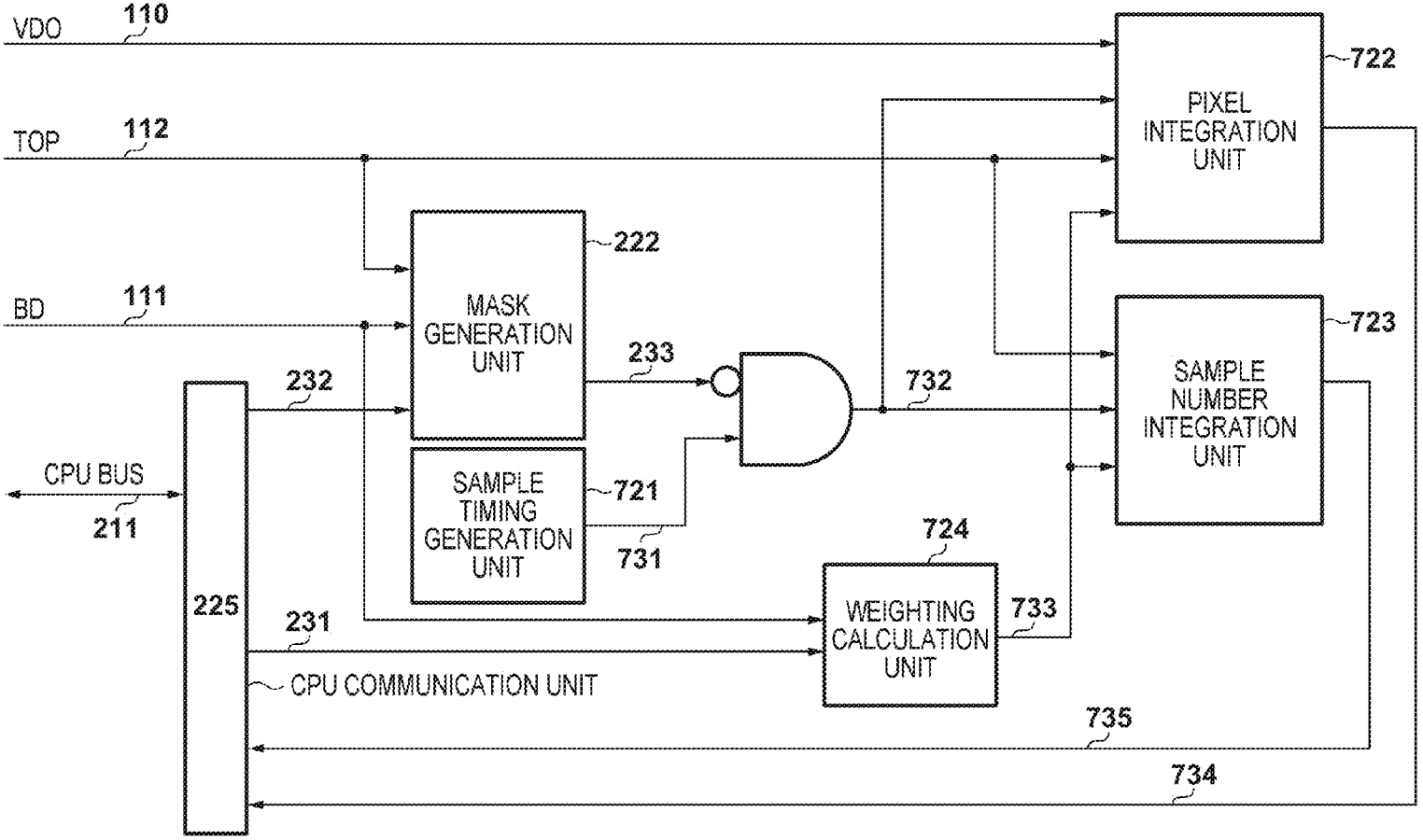
FIG. 8 is a block diagram relating to pixel counting of the second embodiment of the present invention.

FIG. 8 shows an internal block diagram of the pixel count unit 702. The same reference numerals are assigned to the processing similar to that in the first embodiment and the description thereof is omitted. The weighting calculation unit 724 changes the value of a weighting coefficient 733 so as to be inversely proportional to partial magnification of main scanning based on a main scanning width correction setting 231 using the BD signals 111 as a main scanning start reference. For example, assume that the value of the weighting coefficient 733 at a scanning position at which the partial magnification is 100% is 1, and the value of the weighting coefficient 733 at a scanning position at which the partial magnification is 125% is 1.25. For example, weighting may be determined in accordance with the image height in advance and stored in advance in association with the image height.

The operations of a sample timing generation unit 721 are different from those of the sample timing generation unit 221 in the first embodiment, and pixel sample timing signals 731 are assumed to be output with a constant cycle. Note that the interval is assumed to be shorter than the image clock cycle of the VDO signals 110. In this embodiment, it is envisioned that the output cycle of the pixel sample timing signals 731 is approximately 1/10 of the image clock cycle, but in order to further improve the accuracy, the period of the pixel sample timing signals 731 may be shorter than in this embodiment, and in order to reduce the cost of the pixel count unit 702, the cycle of the pixel sample timing signals 731 may be made longer than in this embodiment. Note that in order to correct change in pixel width that is based on the image height using a weighting coefficient, it is desirable that cycle of the pixel sample timing signals 731 is set to be shorter than the pixel width at the on-axis image height.

Only during a time period when the mask signals 233 are at a "LOW" level, in other words, while an image is being rendered, the sample timing signals 731 are propagated as in-image area sample timing signals 732 to a pixel integration unit 722 and a sample number integration unit 723. When the in-image area sample timing signals 732 are at a "HIGH" level and the VDO signals 110 are at a "HIGH" level, the pixel integration unit 722 adds the weighting coefficient 733 output by the weighting calculation unit 724 to an internal pixel integration value 734. Upon receiving the TOP signals 112, the pixel integration value 734 is cleared to 0. When the in-image area sample timing signals 732 are at a "HIGH" level, the sample number integration unit 723 adds the weighting coefficient 733 output by the weighting calculation unit 724 to an internal sample total number integration value 735. Upon receiving the TOP signals 112, the sample total number integration value 735 is cleared to 0. The weighting coefficient 733 may be a value that consecutively changes as a function of a lapsed time (corresponding to the image height) taking BD signals as a start point, for example, but the main scanning line may be divided into several areas such that a value is set for each area.

The pixel integration value 734 and the sample total number integration value 735 are sent to the CPU communication unit 225, and are transmitted to the CPU 201 via the CPU bus 211. The CPU 201 can obtain a laser lighting ratio in one page of an image from the percentage of the pixel integration value 734 to the sample total number integration value 735. A method for predicting the toner consumption amount may be similar to the first embodiment.

Figure 9:
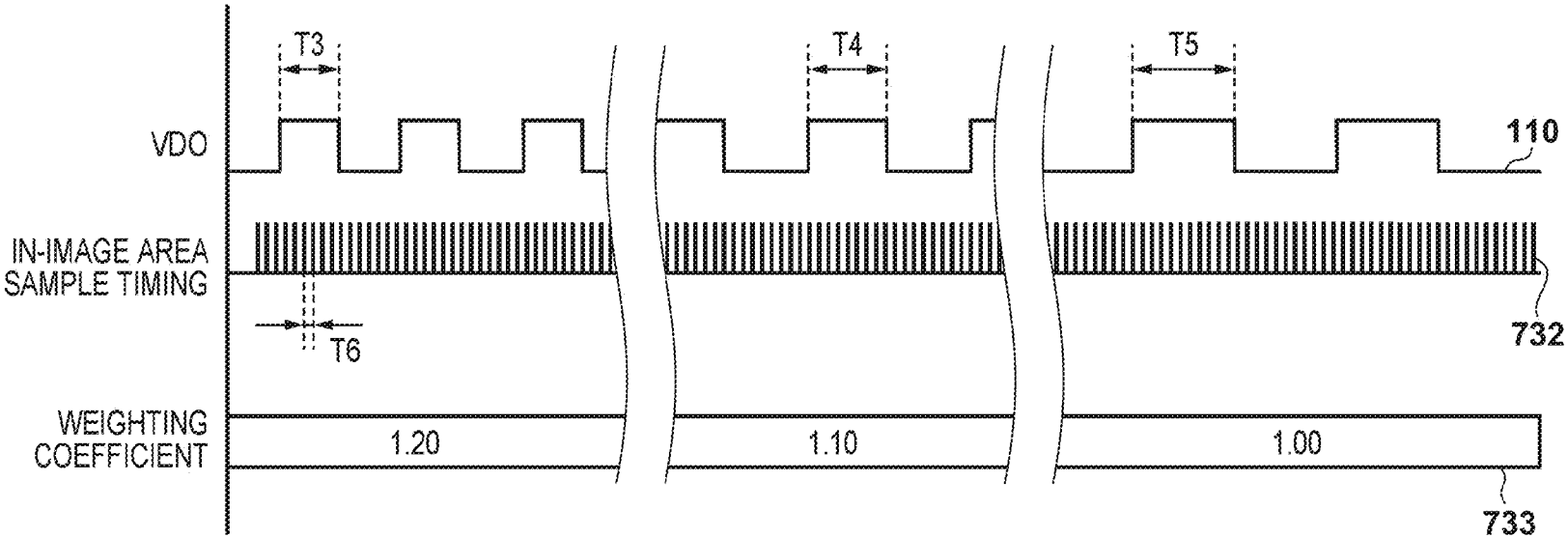
FIG. 9 is a timing chart of synchronization signals and image signals of the second embodiment of the present invention.

The relationship between the VDO signals 110, the in-image area sample timing signals 732 and the weighting coefficient 733 will be described with reference to a time chart in FIG. 9. As described above, the image clock cycle of the VDO signals 110 changes during one main scanning operation. As an example, the image clock cycles T3, T4 and T5 of the VDO signals 110 at different main scanning positions are shown in FIG. 9. A cycle T6 of the in-image area sample timing signals 732 is an output cycle shorter than the above-described image clock cycles T3, T4 and T5, namely, image clock cycles during the main scanning. Here, assume that the partial magnification of the image clock cycle T3 is 120%, the partial magnification of the image clock cycle T4 is 110%, and the partial magnification of the image clock cycle T5 is 100%. The VDO signals 110 are output as image signals that underwent partial magnification correction, and thus among these cycles, the image clock cycle T3 is shortest, and the image clock cycle T5 is longest. In this case, the weighting coefficient 733 is 1.20 when the partial magnification is 120%, 1.10 when the partial magnification is 110%, and 1.00 when the partial magnification is 100%.

As described above, the VDO signals 110 underwent partial magnification correction, and thus the image clock cycle T5 is an output cycle that is 1.2 times of the image clock cycle T3. Therefore, if pixel counting is performed in the same sample timing cycle, the sample count number corresponding to one pixel in the case of the image clock cycle T5 is 1.2 times greater than the image clock cycle T3. Therefore, the sample count value is corrected using the above-described weighting coefficient 733, and the sample count number corresponding to one pixel is uniformly corrected in one main scanning operation. Accordingly, even if the image clock width of the VDO signals 110 fluctuates during the main scanning, the count integration value is corrected in accordance with the fluctuation, and thus the final laser lighting ratio can be obtained as a result equivalent to that in the first embodiment. By using the configuration in this embodiment as well, it is possible to perform pixel counting on image signals, obtain the laser lighting ratio, and predict the toner consumption amount, similarly to the first embodiment.

Third Embodiment

Figure 10:
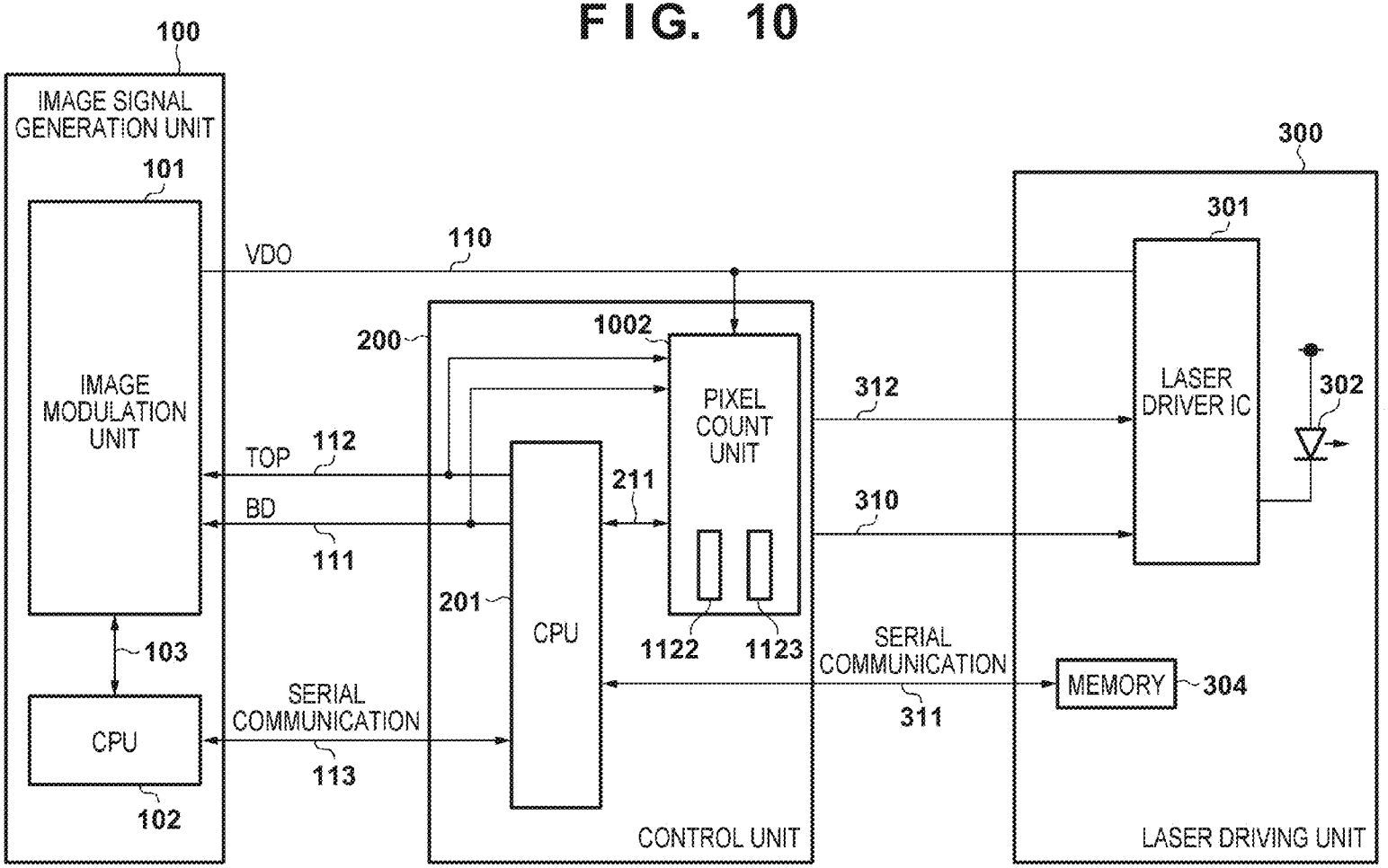
FIG. 10 is an electrical block diagram relating to image formation of the third embodiment of the present invention.

In this embodiment, a configuration will be described in which pixel counting is performed for each of a plurality of areas obtained by dividing the image area in the main scanning direction, and after calculating the laser lighting ratio of each of the areas, the laser lighting ratio is multiplied by a predetermined correction coefficient and the calculation results for the areas are then averaged. A luminous flux converged by a lens that does not have the fθ characteristic such as the image forming lens 406 of this embodiment has different spot diameters at the on-axis image height and an off-axis image height, to be precise. Usually, the image forming apparatus 9 is designed such that change in the spot diameter in one main scanning operation does not influence the image quality, but in this embodiment, in order to more accurately estimate the toner consumption amount, a laser lighting ratio calculation value is corrected by multiplying the weighting coefficient calculated based on the above-described change in spot shape and developing characteristics by the laser lighting ratio at the on-axis image height or an off-axis image height. FIG. 10 is an electrical block diagram of image formation of this image forming apparatus 9 in this embodiment. This example is the same as the first embodiment and the second embodiment in that a pixel count unit 1002 receives the partial magnification characteristics information from the CPU 201 via the CPU bus 211, and obtains various setting values. However, this embodiment is different from the first embodiment and the second embodiment in that a laser lighting ratio calculation unit 1122 and a weighting coefficient multiplication unit 1123 are included.

Figure 11:
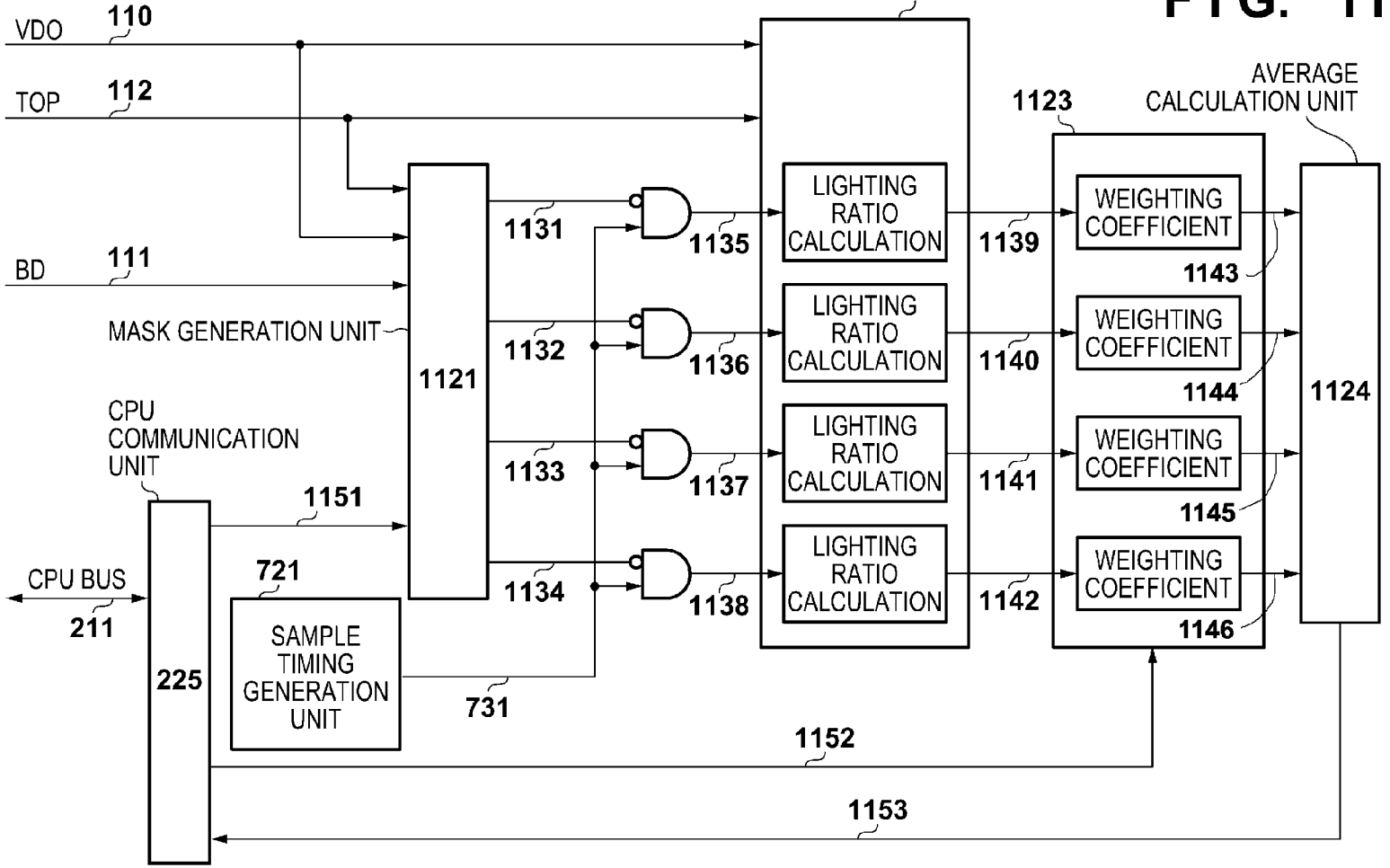
FIG. 11 is a block diagram relating to pixel counting of a third embodiment of the present invention.

FIG. 11 shows the internal block diagram of the pixel count unit 1002. The same reference numerals are assigned to the processing similar to the first embodiment or the second embodiment, and the description thereof is omitted. A mask generation unit 1121 receives, from the CPU communication unit 225, the partial magnification correction information, sub-scanning mask start/end timing information that is based on the TOP signals 112, and main scanning mask start/end timing information that is based on the BD signals 111. In this embodiment, information that is received from the CPU communication unit 225 is expressed as mask generation information 1151. Upon receiving the mask generation information, the mask generation unit 1121 outputs mask signals 1131, 1132, 1133 and 1134. The above four mask signals are signals respectively generated by dividing the mask signals 233 used in the first embodiment and the second embodiment into four in the main scanning direction. Each of the mask signals 1131, 1132, 1133 and 1134 mask the sample timing signal 731 at a predetermined timing, and generate in-image area sample timing signals 1135, 1136, 1137 and 1138. The generated in-image area sample timing signals are transmitted to the laser lighting ratio calculation unit 1122. The in-image area sample timing signals 1135, 1136, 1137 and 1138 are sample timing signals in image areas (also referred to as window areas) that are left to be masked.

The laser lighting ratio calculation unit 1122 has four laser lighting ratio calculation units therein. Each of the laser lighting ratio calculation units is constituted by the pixel counter 223 and the sample number counter 224 in the first embodiment, and a division unit (not illustrated) that obtains the laser lighting ratio by dividing the pixel count value 236 by a sample count value 227. However, in this embodiment, the sample timing generation unit 721 is similar to that in the second embodiment, has a frequency high enough for the frequency of the VDO signals, and is not modulated based on the pixel width of the VDO signals (in other words, image height).

The laser lighting ratio calculation unit 1122 receives the VDO signals 110, the BD signals 111, the TOP signals 112, and in-image area sample timing signals 1135, 1136, 1137 and 1138, internally calculates a laser lighting ratio in each of the areas obtained by dividing the image area into four in the main scanning direction, and transmits laser lighting ratio calculation results 1139, 1140, 1141 and 1142 to the weighting coefficient multiplication unit 1123.

The weighting coefficient multiplication unit 1123 receives a weighting coefficient 1152 transmitted from the CPU communication unit 225, and transmits values obtained by multiplying the laser lighting ratio calculation results 1139, 1140, 1141 and 1142 received from the laser lighting ratio calculation unit 1122 by respectively corresponding weighting coefficients, as laser lighting ratio correction results 1143, 1144, 1145 and 1146, to an average calculation unit 1124. For example, the weighting coefficient 1152 is determined in advance for each window area based on the partial magnification of main scanning, and is stored. The weighting coefficient 1152 is used for correction performed in order to uniformize, over the main scanning line, the number of pulses of the sample timing signal for one pixel that increases as the image height deviates from the axis. That is, the lighting ratio over the entire main scanning is obtained by the average calculation unit 1124. In this embodiment, the pulses of the sample timing signal are counted for each window area, and thus weighting may be performed such that the number of pulses of the sample timing signals of each window area is the same, for example. In the case where the main scanning line is divided into four equal window areas as in this embodiment for example, a weighting coefficient may be used, which equalize the number of pulses of the sample timing signal of each of the two window areas on the center side that is multiplied by the weighting coefficient to the number of pulses of the sample timing signal of each of the two window areas on the outer side.

The average calculation unit 1124 calculates the average value of the laser lighting ratio correction results 1143, 1144, 1145 and 1146, and transmits the result as a final laser lighting ratio calculation result 1153 to the CPU communication unit 225. The CPU 201 obtains the final laser lighting ratio calculation result 1153 via the CPU bus 211.

Figure 12:
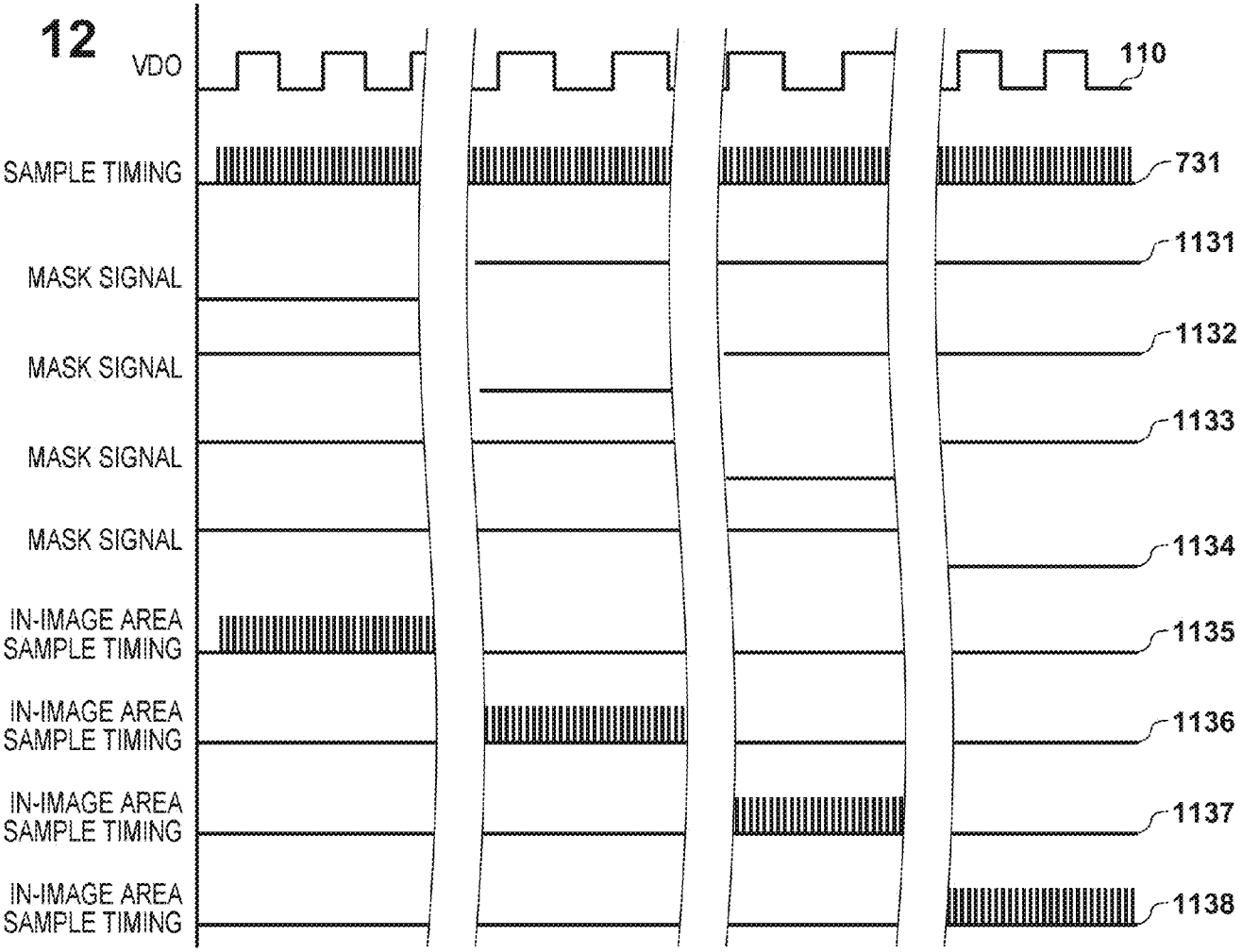
FIG. 12 is a timing chart of synchronization signals and image signals of the third embodiment of the present invention.

The relationship between the VDO signals 110, the sample timing signals 731 and in-image area sample timing signals 1135, 1136, 1137 and 1138 will be described with reference to a time chart in FIG. 12. The sample timing signals 731 are signals that continue to be output at a constant cycle during main scanning. The sample timing signals 731 are masked by the mask signals 1131, 1132, 1133 and 1134, so as to generate the in-image area sample timing signals 1135, 1136, 1137 and 1138. The mask signals 1131, 1132, 1133 and 1134 are output at a "LOW" level only for one area out of the areas obtained by dividing the image area into four in the main scanning direction, the in-image area sample timing signals 1135, 1136, 1137 and 1138 are independently output in the areas obtained by dividing the image area into four in the main scanning direction. By the VDO signals 110 undergoing pixel counting performed using the above-described in-image area sample timing signals 1135, 1136, 1137 and 1138, individual laser lighting ratio calculation results 1139, 1140, 1141 and 1142 in each of the four divided areas can be derived. Thereafter, it is sufficient that using the above-described method, the laser lighting ratio calculation results 1139, 1140, 1141 and 1142 are individually multiplied by a weighting coefficient, and the obtained values are averaged, whereby the final laser lighting ratio calculation result 1153 is obtained.

Note that in this embodiment, an example was described in which the pixel count unit 1002 is configured with the division number of the image area in the main scanning direction being four, but even if the division number of the image area is changed to another value, processing similar to this embodiment can be implemented. In that case, it is sufficient that the weighting coefficients 1152 that are given to the laser lighting ratio calculation unit in the lighting ratio calculation unit 1122 and the weighting coefficient multiplication unit 1123 are prepared such that the number of the weighting coefficients 1152 corresponds to the division number of an image area.

By constituting the pixel count unit 1002 as described above, it becomes possible to predict the toner consumption amount in accordance with the change in the spot diameter during the main scanning.

In addition, even if the image forming lens 406 in the above-described embodiment is replaced by an image forming lens having the fθ characteristic, partial magnification correction processing and pixel counting processing can be realized with the same configuration as the embodiment. In the case of using an image forming lens having the fθ characteristic, it is not necessary to be able to perform correction such that the scanning speed becomes constant using only the fθ characteristic of the lens, and it is sufficient that a magnification error that could not be corrected with the lens is corrected by the image signal generation unit. In that case as well, without changing the configurations of the image signal generation unit, control unit and laser control unit in the above-described embodiments, partial magnification correction and pixel counting can be realized. In addition, the embodiment can also be applied to a configuration in which regarding a portion in the main scanning direction, the scanning speed is corrected by an image forming lens having the fθ characteristic, and regarding the other portions, a magnification error is corrected by the image signal generation unit.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2015-125118, filed Jun. 22, 2015 and 2016-054471 filed Mar. 17, 2016 which are hereby incorporated by reference herein in their entirety.

What is claimed is:

1. An image forming apparatus comprising:

a scanning unit configured to scan, in accordance with image signals, a photosensitive member with laser light in a main scanning direction at a scanning speed that is not constant;

an image signal generation unit configured to generate image signals that are changed such that the faster the scanning speed is, the narrower an image signal width becomes;

a clock signal generation unit configured to generate sampling clock signals for sampling the image signals whose image signal width is changed such that the faster the scanning speed is, the shorter a sampling interval becomes; and a count unit configured to count image signals whose image signal width is changed based on the sampling clock signals.

2. The image forming apparatus according to claim 1, wherein the count unit counts values regarding pixels to be scanned by the scanning unit with the laser light, or values regarding pixels not to be scanned.

3. The image forming apparatus according to claim 1, wherein the clock signal generation unit changes a cycle of the sampling clock signals based on a partial magnification corresponding to a position of the laser light in the main scanning direction, in accordance with the position in the main scanning direction.

4. The image forming apparatus according to claim 1, wherein the clock signal generation unit generates the sampling clock signals such that count numbers of pixels in image signals whose image signal width was changed are equal.

5. The image forming apparatus according to claim 1, wherein the scanning speed is a speed that is faster at an end portion in the main scanning direction than at a center portion, and a sampling interval of the sampling clock signals is shorter at the end portion than at the center portion.

6. The image forming apparatus according to claim 5, wherein a cycle of the sampling clock signals changes in inverse proportion to a partial magnification corresponding to the position of the laser light in the main scanning direction.

7. The image forming apparatus according to claim 1, further comprising:

a correction unit configured to correct a result of the counting performed by the count unit, using a weighting coefficient that is based on a partial magnification corresponding to a position of the laser light in the main scanning direction.

8. The image forming apparatus according to claim 7, wherein the weighting coefficient changes in inverse proportion to the partial magnification.

9. The image forming apparatus according to claim 1, further comprising:

a control unit configured to obtain a lighting ratio of the laser light based on a value regarding pixels counted by the count unit.

10. The image forming apparatus according to claim 9, wherein the control unit estimates a consumption amount of a developing agent or a remaining amount of the developing agent based on the lighting ratio of the laser light.

11. The image forming apparatus according to claim 10, wherein the control unit divides an image area in the main scanning direction into a plurality of areas in order to obtain the lighting ratio for each of the plurality of areas, corrects the lighting ratio for each of the areas using a correction coefficient that is based on a partial magnification corresponding to the position of the laser light in the main scanning direction in order to obtain an overall lighting ratio, and using the overall lighting ratio, estimates the consumption amount of the developing agent or the remaining amount of the developing agent.

12. The image forming apparatus according to claim 1, wherein the image signal generation unit shortens an image clock such that the faster the scanning speed is, the narrower the image signal width becomes, and/or lengthens the image clock such that the slower the scanning speed is, the wider the image signal width becomes.

13. The image forming apparatus according to claim 1, wherein the image signal generation unit thins out image data pieces such that the faster the scanning speed is, the narrower the image signal width becomes, and/or inserts image data pieces such that the slower the scanning speed is, the wider the image signal width becomes.

14. An image forming apparatus, comprising:

a scanning unit configured to scan, in accordance with image signals, a photosensitive member with laser light in a main scanning direction at a scanning speed that is not constant;

an image signal generation unit configured to generate image signals that are changed such that the faster the scanning speed is, the narrower an image signal width becomes;

a clock signal generation unit configured to generate sampling clock signals for sampling image signals whose image signal width is changed;

a count unit configured to count image signals whose image signal width is changed, based on the sampling clock signals; and a correction unit configured to correct a result of the counting performed by the count unit, using a weighting coefficient that is greater, the faster the scanning speed is.

15. The image forming apparatus according to claim 14, wherein the clock signal generation unit generates the sampling clock signals having a constant cycle.

16. The image forming apparatus according to claim 14, wherein the count unit counts values regarding pixels to be scanned with the laser light by the scanning unit or values regarding pixels not to be scanned.

17. The image forming apparatus according to claim 14, further comprising:

a control unit configured to divide an image area in the main scanning direction into a plurality of areas in order to obtain a lighting ratio for each of the plurality of areas, wherein the control unit corrects the lighting ratio for each of the areas, using a correction coefficient that is based on a partial magnification corresponding to a position of the laser light in the main scanning direction.

18. The image forming apparatus according to claim 14, wherein the weighting coefficient changes in inverse proportion to a partial magnification corresponding to the position of the laser light in the main scanning direction.

19. A method for counting pixels in an image forming apparatus including a scanning unit for scanning, in accordance with image signals, a photosensitive member with laser light at a scanning speed that is not constant, the method comprising:

generating image signals whose image signal width is changed in accordance with a position of the laser light in a main scanning direction, based on a partial magnification corresponding to the position of the laser light in the main scanning direction;

generating sampling clock signals for sampling the image signals whose image signal width is changed, in accordance with the image signals whose image signal width is changed; and counting the image signals whose image signal width is changed based on the sampling clock signals.

20. A method for counting pixels in an image forming apparatus including a scanning unit for scanning, in accordance with image signals, a photosensitive member with laser light at a scanning speed that is not constant, the method comprising:

generating image signals whose image signal width is changed in accordance with a position of the laser light in a main scanning direction, based on a partial magnification corresponding to the position of the laser light in the main scanning direction;

generating sampling clock signals for sampling the image signals whose image signal width is changed, counting the image signals whose image signal width is changed, based on the sampling clock signals; and correcting a result of the counting, using a weighting coefficient that is based on the partial magnification.

* * * * *